United States Patent [19]

Gunther, Jr. et al.

[11] 4,343,129

[45] Aug. 10, 1982

[54] MECHANISM OF MAKING AN ENVELOPE

[75] Inventors: William H. Gunther, Jr., Mystic; Roman M. Golicz, Clinton; James W. Hough, Madison, all of Conn.

[73] Assignee: G.B.R., Ltd., Dover, Del.

[21] Appl. No.: 55,551

[22] Filed: Jul. 9, 1979

Related U.S. Application Data

[63] Continuation of Ser. No. 846,902, Oct. 31, 1977, abandoned, which is a continuation-in-part of Ser. No. 680,788, Apr. 27, 1976, Pat. No. 4,071,997.

[51] Int. Cl.[3] ..... B65B 11/48

[52] U.S. Cl. ..... 53/206; 53/209

[58] Field of Search ..... 53/460, 461, 206, 209, 53/218, 178, 266 A; 93/62, 63 R, 63 M; 229/69; 893/216

[56] References Cited

U.S. PATENT DOCUMENTS

| | | | |
|---|---|---|---|
| 1,247,364 | 11/1917 | Bracy | 53/157 |
| 1,879,990 | 9/1932 | Oles | 93/62 |
| 2,224,513 | 12/1940 | Hormlund | 93/637 |
| 2,932,929 | 4/1960 | Fahrenbach | 53/209 |
| 3,059,391 | 10/1962 | Vorks | 53/206 |
| 3,457,696 | 7/1969 | Berkley | 53/460 |
| 3,618,284 | 11/1971 | Gendron | 93/637 |
| 3,626,821 | 12/1971 | Gendron | 93/63 M |
| 3,628,304 | 12/1971 | Hornung | 53/460 |
| 3,673,763 | 7/1972 | Dorfmann | 53/209 |
| 3,685,253 | 8/1972 | Herrell et al. | 53/228 |
| 3,894,905 | 7/1975 | Ehlscheid | 53/460 |
| 4,034,210 | 7/1977 | Hill et al. | 53/266 A |
| 4,051,995 | 10/1977 | Wieman | 229/69 |
| 4,071,997 | 2/1978 | Gunther, Jr. | 53/460 |

*Primary Examiner*—John Sipos

*Attorney, Agent, or Firm*—Holland, Armstrong, Wilkie & Previto

[57] ABSTRACT

An improved machine and method of making and folding an insert and an envelope.

9 Claims, 21 Drawing Figures

Fig. 1.
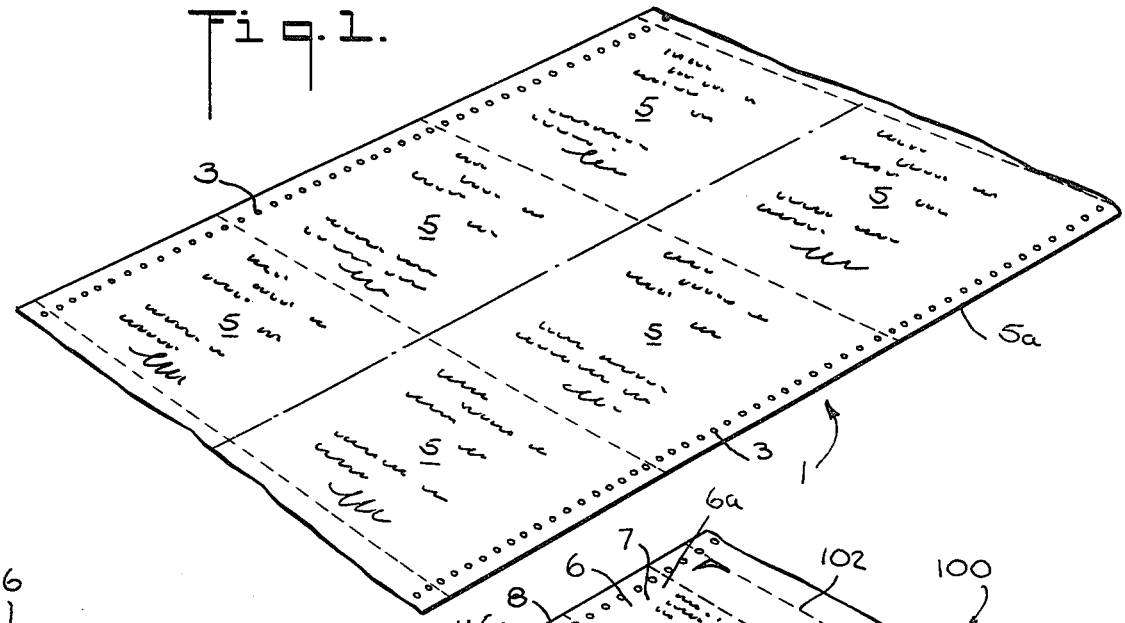
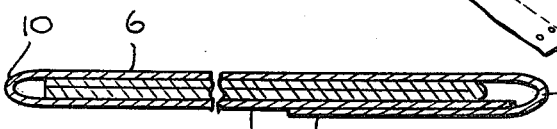
Fig. 4.
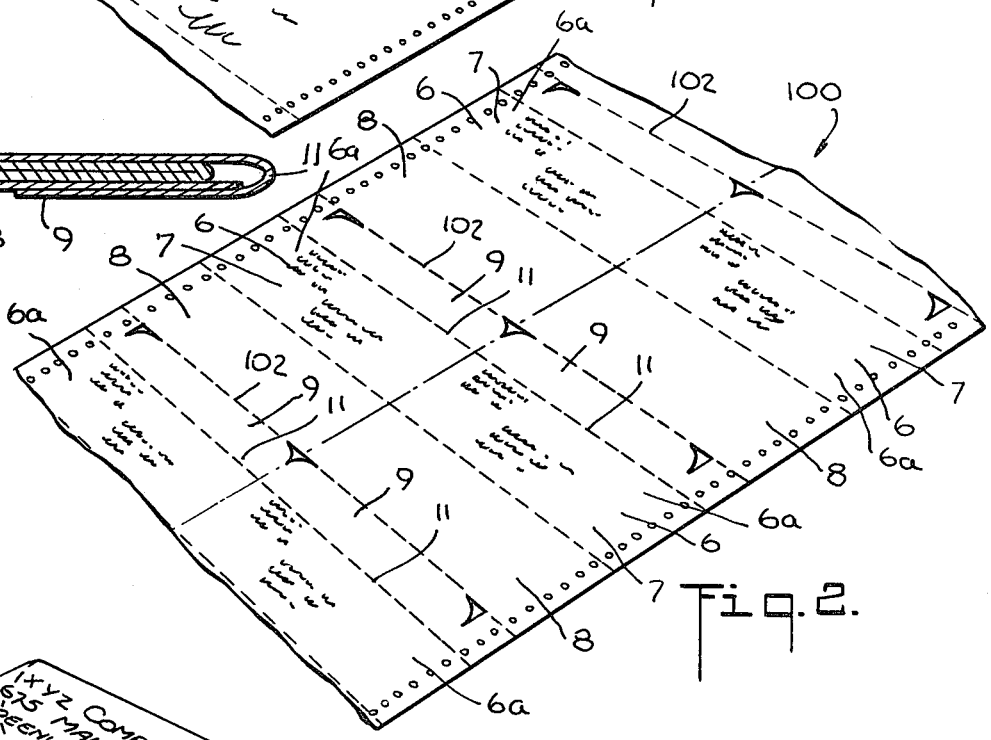
Fig. 2.
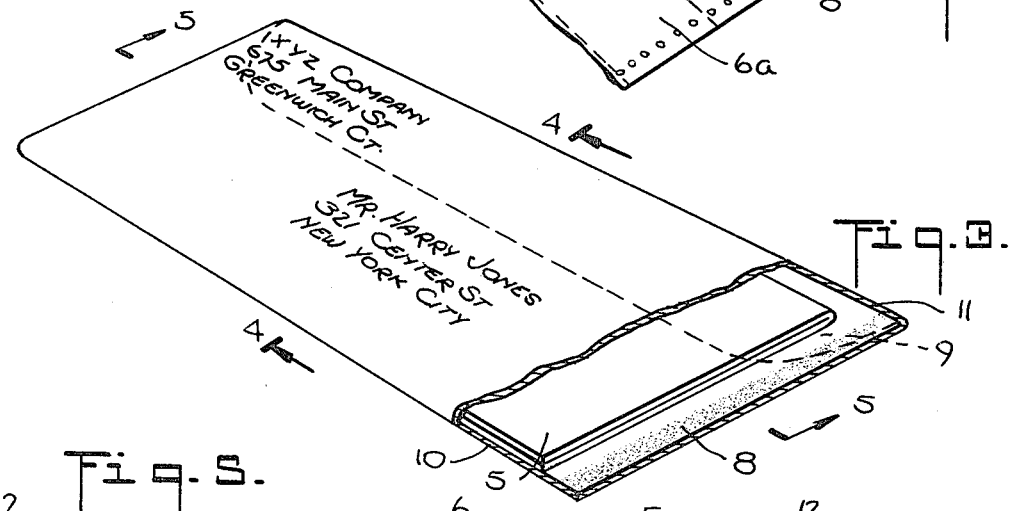
Fig. 3.
Fig. 5.
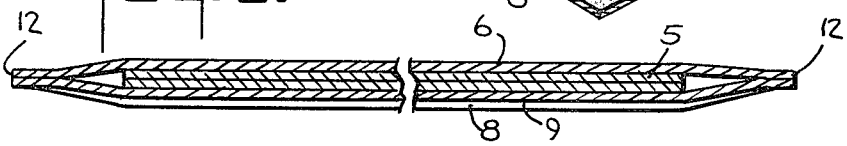

MECHANISM OF MAKING AN ENVELOPE

CROSS REFERENCE

This application is a continuation of pending U.S. application Ser. No. 846,902 filed Oct. 31, 1977 now abandoned which is a continuation-in-part of U.S. patent application Ser. No. 680,788 filed Apr. 27, 1976 now U.S. Pat. No. 4,071,997.

DESCRIPTION

The present invention is directed to an improved method and mechanism of making and folding an envelope and more particularly to a mechanism and method of folding an envelope around a letter or some other insert.

In various promotions, such as solicitations for subscribers, funds, etc. it is desirable for the envelope and the letter, or other similar insert or message enclosed within the envelope, to be personalized.

Even if the personalized insert and envelope are both automatically printed by a computer, it is an expensive and a time consuming operation to stuff the personalized letter or other insert into the corresponding personalized envelope and to seal it. In addition, it is desirable to add additional inserts to be sent with the letter.

Present machinery and methods do not provide for automatic feeding of inserts and envelopes for automatic wrapping of envelopes around the inserts and for automatically adding additional inserts to the envelopes.

The present invention overcomes these difficulties and has for one of its objects the provision of an improved mechanism and machine which will automatically stuff a personalized letter or some other insert, such as a return envelope or the like, into a personalized envelope, which will permit additional inserts to be automatically added to the envelope and which will automatically seal the contents within the envelopes.

Another object of the present invention is the provision of an improved method and machine which will apply adhesive to the envelopes at some time before the folding operation.

Another object of the present invention is the provision of an improved method and machine which will combine inserts and envelopes fed from different sources and form them into a completed mailing enclosure.

Another object of the present invention is the provision of an improved mechanism for folding an envelope.

Other and further objects of the invention will be obvious upon an understanding of the illustrative embodiment about to be described, or will be indicated in the appended claims, and various advantages not referred to herein will occur to one skilled in the art upon employment of the invention in practice.

A preferred embodiment of the invention has been chosen for purposes of illustration and description and is shown in the accompanying drawings forming a part of the specification, wherein:

FIG. 1 is a perspective view of a continuous sheet or web having thereon a series of inserts, such as a personalized letter which are to be positioned within an envelope.

FIG. 2 is a perspective view of the continuous sheet or web having a series of envelopes for receiving the inserts.

FIG. 3 is a perspective view of the sealed personalized envelope with the insert means therein.

FIG. 4 is a sectional view taken along line 4—4 of FIG. 3.

FIG. 5 is a sectional view taken along line 5—5 of FIG. 3.

Figures 6A, 8, 9:
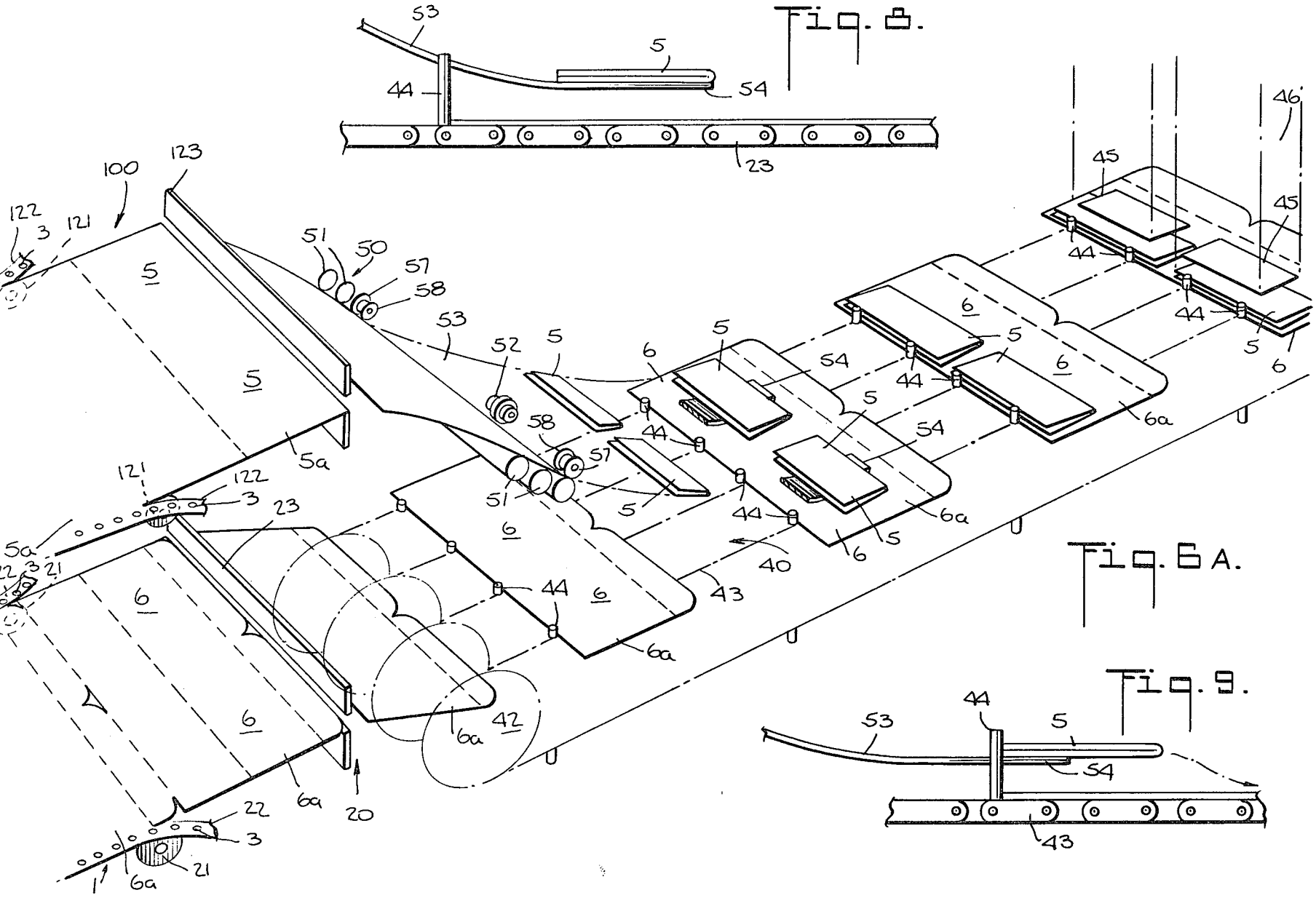
FIG. 6A shows the first portion of the improved machine used for performing the improved method of the present invention.
FIG. 8 is a detail showing the letter in position over an envelope.
FIG. 9 is a similar detail showing the letter being placed on the envelope.
Figure 6B:
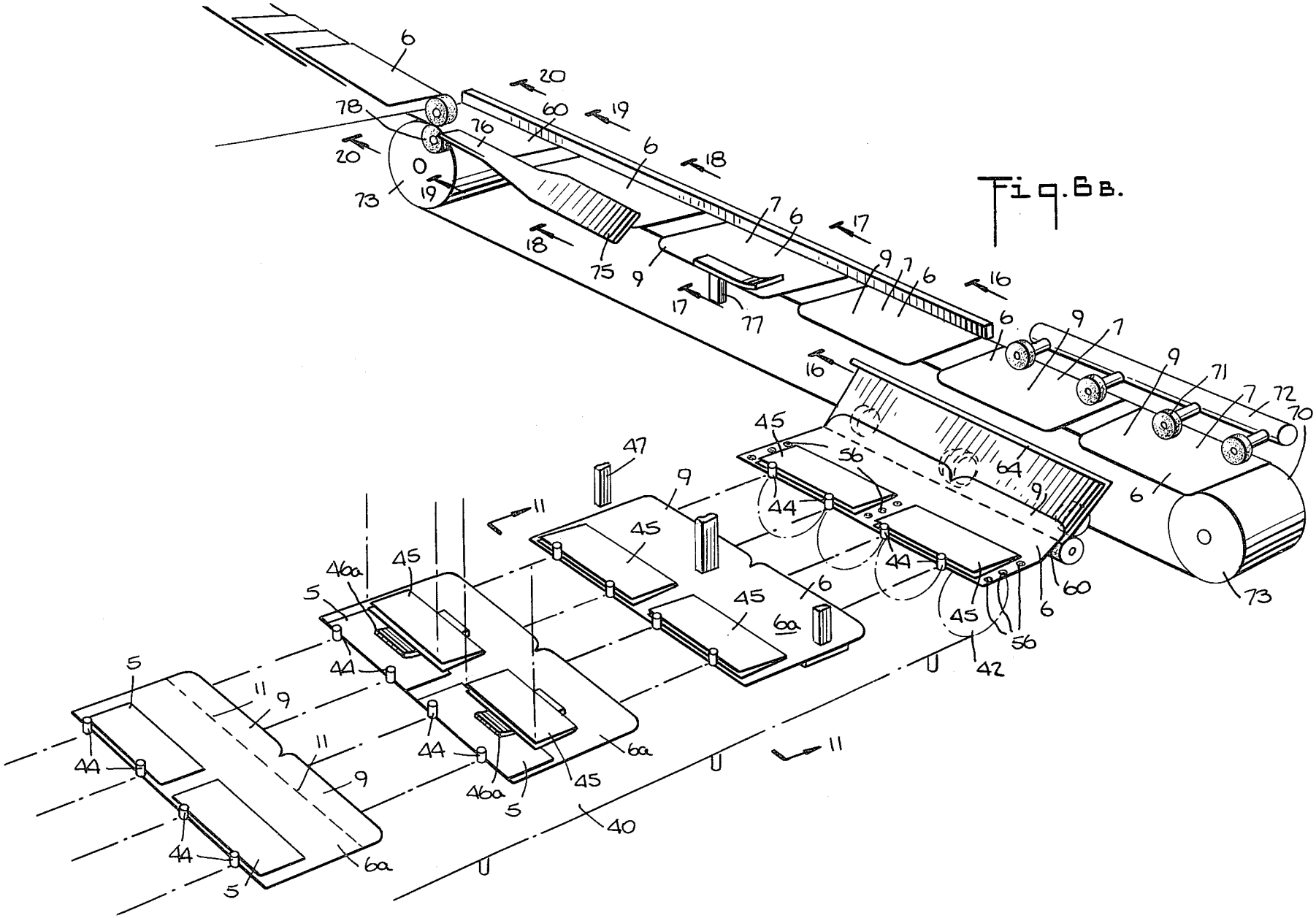
FIG. 6B shows the other portion of the same machine shown in FIG. 6A.

Referring more particularly to the drawings, the insert web 1 from which the insert is made is shown in FIG. 1 and comprises a continuous composite sheet having a series of openings 3 along each edge to accommodate pins of a sprocket type feed mechanism (not shown). The web may be stored in a roll or in a fan fold, as may be desired.

The web 1 is divided by transverse cut lines 2, which may be perforations, into a plurably of insert assemblies **5*a* comprising pair of transversely located inserts 5. The inserts 5** may be a letter or a return envelope or some other insert.

The envelope web 100 from which the envelopes 6 are made is shown in FIG. 2 and comprises a continuous composite sheet having a series of openings 103 along each edge to accommodate pins of a sprocket type feed mechanism (not shown). The web 100 may be stored in a roll or in a fan fold, as may be desired.

The web 100 is divided by transverse cut lines 102, which may be perforations, into a plurality of letter assemblies **6*a* comprising a pair of transversely located envelopes 6**.

Each envelope 6 has a front panel 7, which may have a personalized address and which may correspond to the personalized address on its corresponding insert 5, as well as a return address. Each envelope 6 has a rear panel 8 attached to front panel 7 by a fold line 10 and flap 9 attached by fold line 11 to the front panel 7. The fold lines 10 of each adjacent envelope 6 are coextensive with each other and the fold lines 11 of each are also coextensive with each other.

In general, the method and mechanism of the present invention comprises separating the envelope assemblies and insert assemblies from their respective webs, folding the insert assembly 5*a* and dividing the folded insert assembly 5*a* along the center to form two inserts 5, placing the folded inserts 5, as well as any other inserts 45, on the rear panel 8 of the envelopes 6, folding the front panel 7 over the inserts 5, as well as other inserts 45, along fold 10, sealing the edges, folding the flap 9 over the rear panel 8 and adhering it to the panel 8 to complete the envelope. The tractor holes 3 and 103 are preferably removed before any of the other steps are performed.

A web cutter assemblies 120 and 20 are provided to separate the insert assemblies 5*a* and the envelope assemblies 6*a* from their respective webs 100 and 1. Each cut envelope assembly 6*a* is delivered to a moving first conveyor assembly 40. Each insert assembly 5*a* is delivered to a folding, slitting and trimming mechanism 50 which folds each insert assembly 5*a* divides it into inserts 5, trims the inserts to size and deliver them onto its corresponding envelope 6 of envelope assembly 6*a* which is moving with the conveyor assembly 40. Thereafter, additional inserts 45 may be positioned on the envelope 6.

The envelope assemblies 6*a* then receive an adhesive to permit the end edges 12 to be sealed. At the appropriate time, the leading edges of each envelope assembly 6*a* is folded over the previously deposited letters 5 and inserts 45 by a folding assembly 60. Simultaneously, the end edge areas 12 which have previously received adhesive are pressed together to seal the end edges 12 thereof.

After discharge from the first conveyor assembly 40, the envelopes 6 are placed on a moving second conveyor assembly 70 where the flap 9 is folded over the rear panel and sealed thereto to complete the letter.

The continuous webs 1 and 100 are preferably fed from a fan fold (not shown) storage areas, however, they can also be fed from a roll, if desired. It is also within the purview of the present invention that the machine may operate with a previously separated letter assembly and envelope assembly.

The web 1 is first moved past a pair of side knife wheels 21 which remove edge strips 22 which have the feed holes 3 therein. The web 1 is then moved over cutting assembly 20 which comprises a knife edge 23 which separates the envelope assemblies 6*a* from each other.

Immediately after the cutter assembly 20 is a chute 25 which is adapted to direct the envelope assembly 6*a*onto conveyor assembly 40 the length of the envelope assembly 6*a* is long enough for the leading edge to be deposited on the conveyor when the knife cuts. In addition, suitable rollers 26 may be provided to help move the envelope assembly onto the conveyor.

The web 100 is first moved past a pair of side knife wheels 121 which remove edge strips 122 which have the feed holes 3 therein. The web 100 is then moved over cutting assembly 120 which comprises a knife edge 123 which separates the insert assemblies 5*a* from each other.

Immediately after the cutter assembly 120 is a chute 125 which is to direct the insert 5*a* into a folding assembly 50. As shown, the insert assemblies 5*a* are long enough for the leading edge to be gripped and pulled by the folding mechanism when the knife cuts.

The conveyor assembly 40 comprises a continuously moving conveyor 41 driven by a wheel and chain assembly 42–43. The conveyor 41 has a plurality of transversely located upwardly extending longitudinally spaced drive pins 44. A pair of drive pins 44 are located on each side of the center line of the conveyor. When the envelopes are deposited onto the conveyor 41, the pins 44 strike the rear edge of the envelope assembly 6*a*, to move it along with the conveyor 41. The pins 44 are adapted not only to strike and move the envelope assembly 6*a* but also to cause the inserts 5 and the inserts 45, if any, to be deposited onto the envelopes 6, and to move the envelope assembly 6*a*, inserts 5 and other inserts 45 along.

The folding mechanism 50 which folds the insert assembly 5*a* before it is deposited onto the envelope assembly 6 is in the usual form, for example, similar to the one shown in U.S. Pat. No. 1,879,990, and comprises a series of rollers 51 which will fold the insert assemblies 5*a*in two or more folds depending on the particular type of folding desired. The folding mechanism 50 is a standard folding mechanism and, hence, will not be described in greater detail. If desired the inserts 5 may be insert which need not be folded in which event the folding mechanism 50 is not necessary.

After the insert assembly 5*a* is folded, it is moved past a rotary knife 52 which divides the insert assembly 5*a* longitudinally into two separate inserts 5 and past rimming rotary knives 57 which removes any excess material to trim the inserts to size, if that is desired. The inserts 5 are deposited on an inclined chute 53 which overlies the conveyor 41, and which terminates in a toe 54. The two inserts 5 slide down the chute 53 until they rest on the toe 54. Rollers 58 which may be mounted on knives 57 may be used to push the inserts 5 downwardly. The toe 54 is positioned in close adjacency over the conveyor 41 and is substantially parallel to the conveyor 41. The chute 53 has longitudinal slits 55 therein to permit the pins 44 to move therethrough. Guide rails 56 are provided to prevent the sliding inserts 5 from angling when sliding down chute 53.

With the inserts 5 resting on toes 54, the pins 44 which are moving the envelope assembly 6 forward, move through the slits 55 and strike the rear edge of the folded inserts 5 so as to move them off toe 54 and deposit them on their corresponding envelopes 6 of the envelope assembly 6*a*. Since the inserts 5 are moving at about the same speed as the envelope assembly 6*a*, the chute 53 and rollers 58 allows inserts 5 to move down to toes 54 at least as quickly as it takes the envelope to be positioned below toes 54 so that each insert 5 will be deposited on its respective envelope 6.

The envelope assembly 6*a* with inserts 5 thereon is then moved by pins 44 beneath an insert depositing assembly 46 which holds inserts 45. The insert depositing assembly 46 is preferably of the suction type, however in the drawing, the assembly 46 is shown as comprising a chute 46 which holds the lowermost insert 45 suspended over the moving conveyor 41 on a shoe 46*a*. The shoe 46*a* is positioned over the conveyor 41 a distance less than the height of the pins 44. Hence the moving pins 44 strike the insert 45 and push it on the inserts 5.

Figure 10:
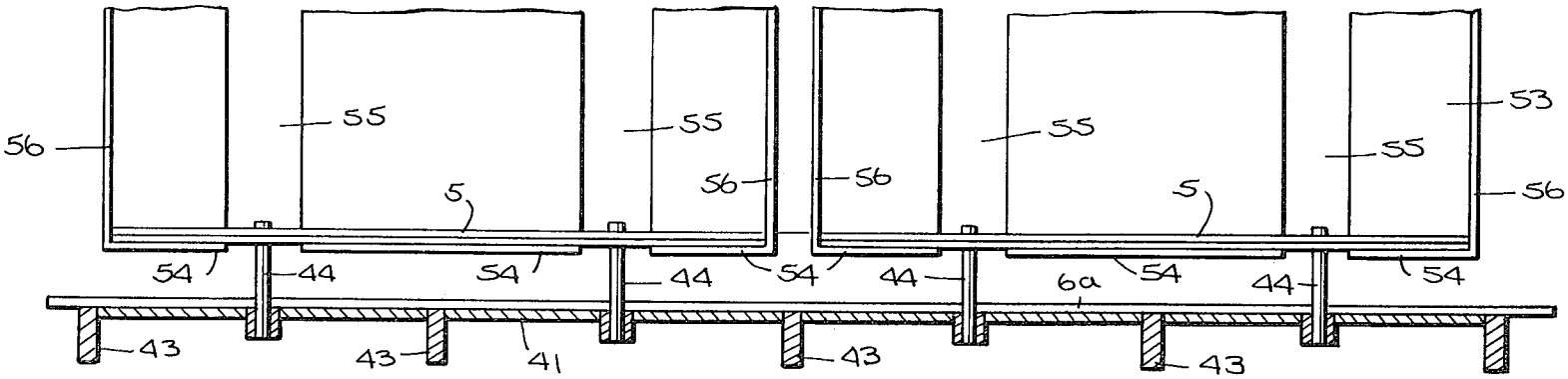
FIG. 10 is a sectional view taken along line 10—10 of FIG. 7.
Figure 7:
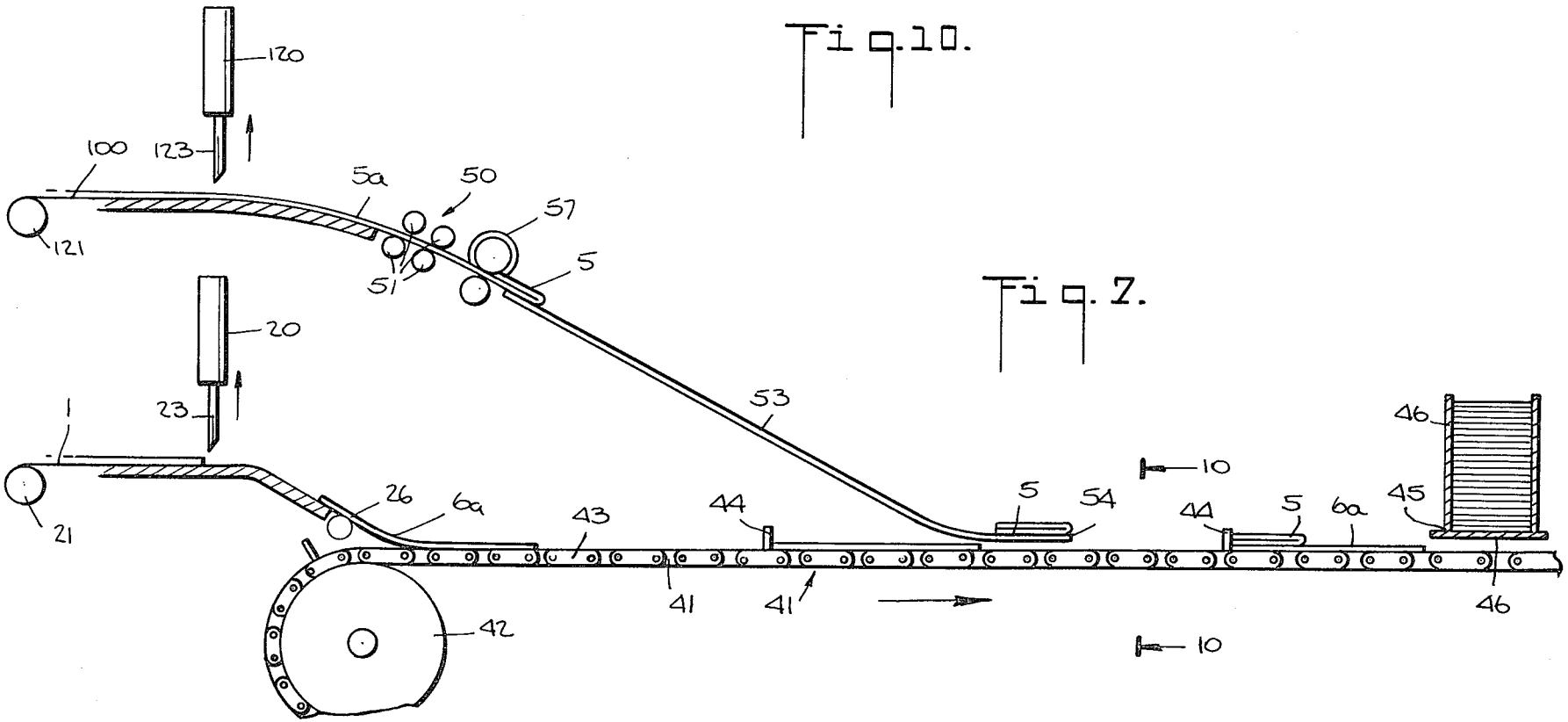
FIG. 7 is a side elevational view of the portion of the machine shown in FIG. 6A.
Figure 11:
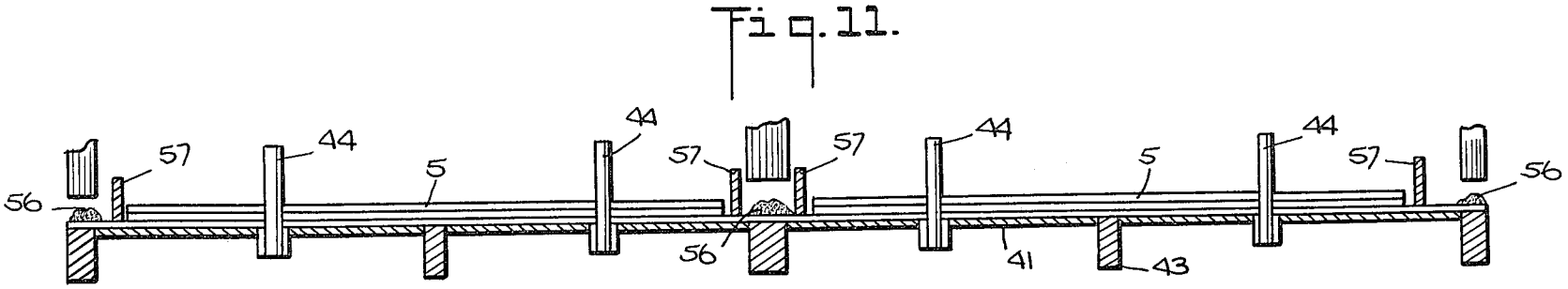
FIG. 11 is a sectional view taken along line 11—11 of FIG. 6B.
Figure 12:
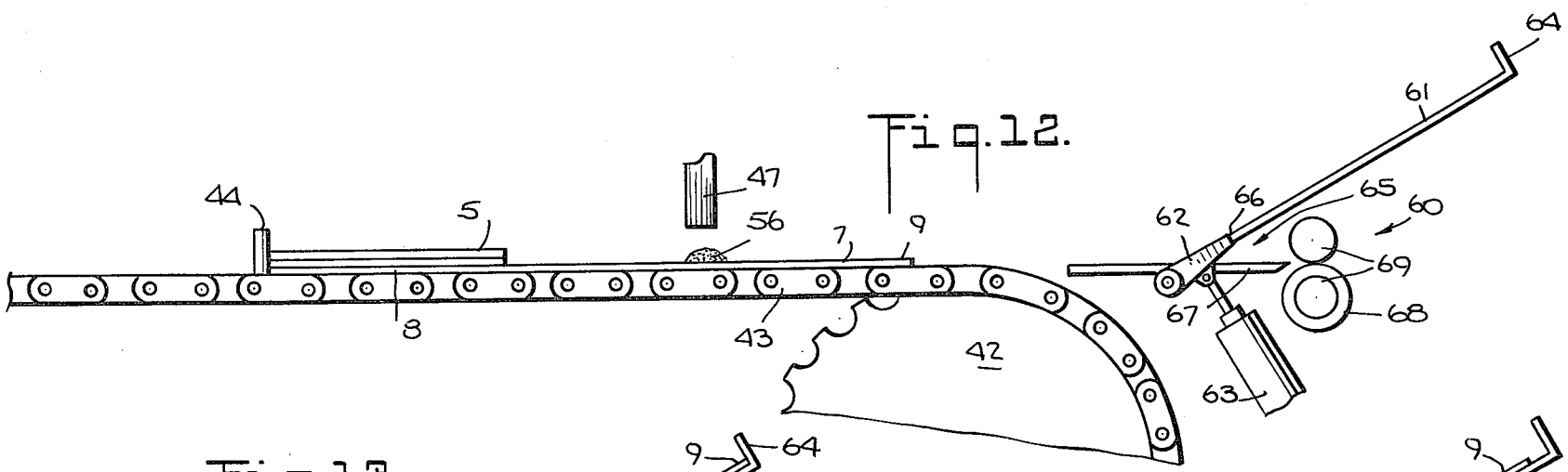
FIG. 12 is a side view of an adhesive applicator for applying adhesive to the envelope.
Figure 14:
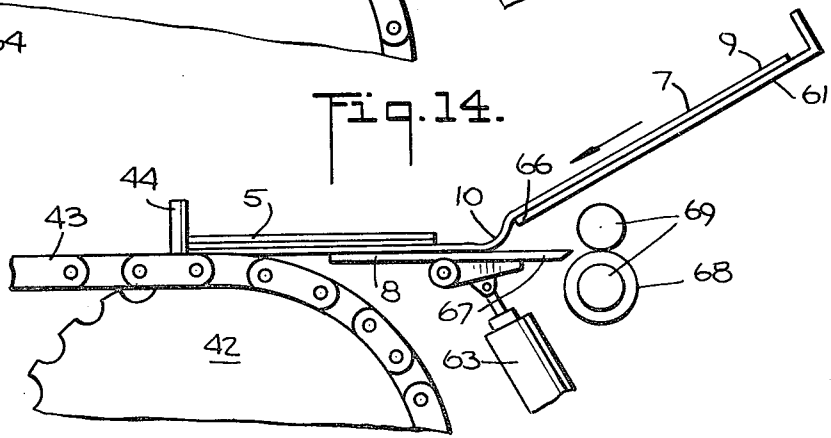
FIG. 14 is a detail showing the second step in the envelope folding mechanism.
Figure 13:
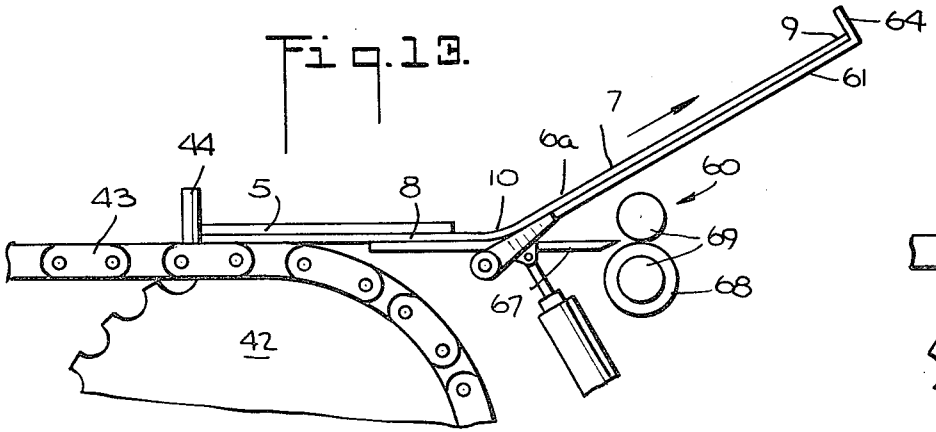
FIG. 13 is a detail of the first step in the envelope folding mechanism.
Figure 15:
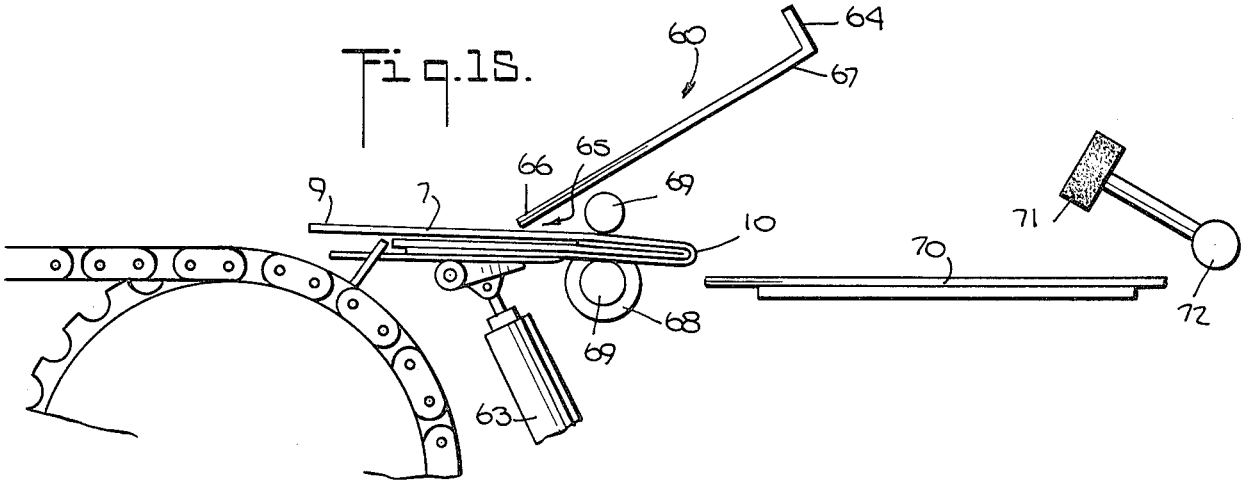
FIG. 15 is a detail showing the third step in the envelope folding mechanism.
Figure 16:
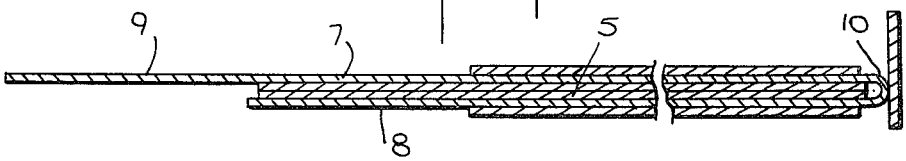
FIG. 16 is a sectional view taken along line 16—16 of FIG. 6B.
Figure 17:
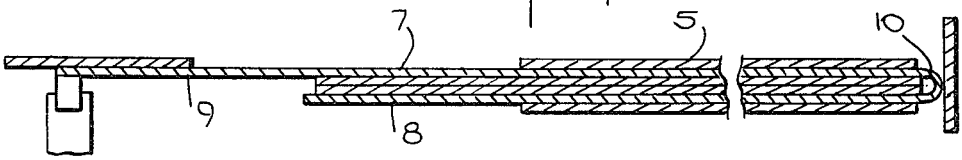
FIG. 17 is a sectional view taken along line 17—17 of FIG. 6B.
Figure 18:
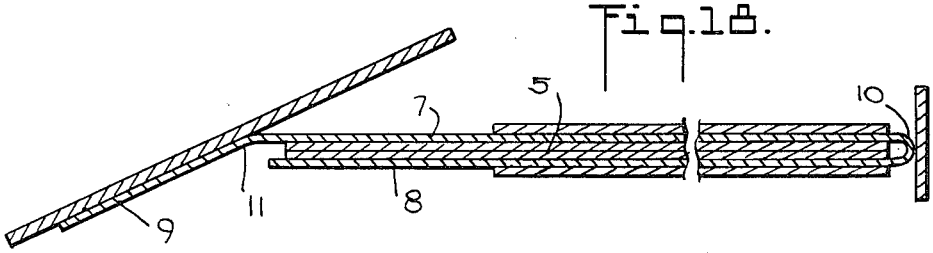
FIG. 18 is a sectional view taken along line 18—18 of FIG. 6B.
Figure 19:
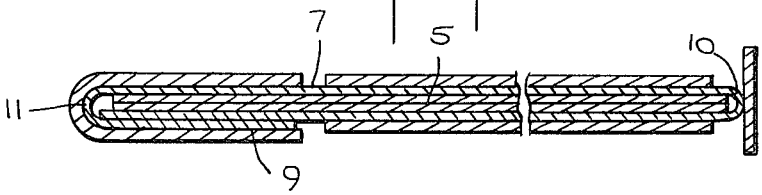
FIG. 19 is a sectional view taken along line 19—19 of FIG. 6B.
Figure 20:
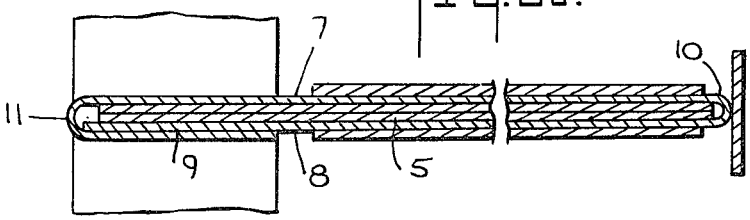
FIG. 20 is a sectional view taken along line 20—20 of FIG. 6B.

The combination is then moved by pins 44 beneath an adhesive applicator assembly 47 which applies adhesive to center and end strips of the envelope assembly 6*a*, which will become edges 12 when the envelopes 6 are severed. The adhesive applicator 47 may be any conventional type of applicator, such as a sprayer, a roller or a spotter. In the preferred form of the invention, the adhesive 156 is a hot melt wax which is applied in spots by center nozzle 48 and end nozzles 49 along the center and side strips of envelope assembly 6*a*. Guide rails 157 which guide spaced inserts 5 (FIG. 10) prevent adhesive 156 from being applied to the inserts 5. However a pre-gummed envelope may also be used if desired.

The combination is then moved to an envelope wrapping assembly 60 which comprises and upwardly inclined ramp 61 and diverting device 62 adapted to divert the leading edge of the envelope assembly 6 unto the ramp 61. The diverting fingers 62 are shown as being lowered by a hydraulic cylinder 63. However any other means, such as a cam, may be used to control the fingers 62.

As the pins 44 move the envelope assembly 6*a*, together with inserts 5 and 45 along, the diverting device 62 is in its raised position so that the leading edge of the envelope assembly 6*a* embodying flap 9 moves up the ramp 61 until it strikes a stop 64. At that point, the device 62 is lowered to open a gap 65 between lower edge 66 of ramp 61 and feed plate 67. As the pins 44 continue to move the combination forward the envelope assembly 6*a* buckles along fold along 10 and the envelope assembly 6*a* is pushed through the gap 65.

Rollers 69 move faster than conveyor 40 so that as soon as the envelope starts moving through gap 65 the rollers 69 pull it through the gap and onto conveyor 70.

As the folded envelope assembly 6*a* and its contents letters 5 and inserts 45 are moved by rollers 69, a rotary cutting wheel 68 severs the envelope assembly 6*a* into two envelopes 6. The rollers 69 also cause the two panels 8 and 7 of each envelope 6 to adhere to each other along edges 12 where the adhesive 56 has been previously applied.

The folded and edge sealed envelope 6 are then moved onto second conveyor 70 which is moved by drive 73 which is at an angle (preferably at a right angle) to the first conveyor 41. Rollers 71 are mounted on pivotally movable shaft 72 to apply pressure to the envelopes 6 to force them to be moved by conveyor 70. Shaft 72 rocks upwardly to raise the rollers 71 to permit envelopes 6 to be deposited on conveyor 70 and then rocks donwnwardly to lower rollers 71 to apply pressure to envelopes 6. The rocking of shaft 72 is timed to the movement of the plate 67 by timing mechanism which is not shown for reasons of clarity.

The second conveyor 70 moves the envelopes past a flap folding shoe 75 which is especially contoured (as shown in FIGS. 15 to 18), to fold the flap 9 as each envelope moves past it. An adhesive is applied to flap 9 by applicator 77 as the envelope 6 moves past it. The shoe 75 has a bend 76 which terminates in a U-shaped configuration to fold the flap 9. The envelopes are then moved past pressure roller 78 which seals flap 9 and are then moved off the conveyor 71.

The machine described above was described in connection with a web having a pair of inserts 5 and envelopes 6 in side-by-side relationship to each other. It will be understood that the mechanism may be used with a web having a single insert and envelope in which case there is no need to centrally sever the web.

It is also possible for the envelope blank to have an adhesive applied to it at an earlier stage which can then be activated either by moisture or by pressure or any other appropriate means to form the proper sealing of the envelope.

After the sealing of the flap of the envelope, they can be sorted into various categories, such as by weight for different amounts of postage or zip code sorting.

In addition, information gathered from the original insert as it is passed through the machine can be read to add inserts selectively at the insert stations.

It is also possible for the blanks to have a window therein for addresses to show through.

Hence, the present invention provides a machine and method which will automatically stuff an insert into an envelope, which permits additional inserts to be added to the envelope and which automatically seals the contents.

Furthermore the present invention permits the envelope blank to have an adhesive applied to it automatically before the folding operation.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A mechanism for forming an envelope, comprising an envelope assembly having a sealing flap and an insert assembly, a predetermined envelope assembly being adapted to envelope a predetermined insert assembly, means for moving said predetermined envelope assembly along one path and for moving said predetermined insert assembly along another path, said paths moving in the same direction, said means for moving said predetermined insert assembly includes means for positioning the predetermined insert assembly in superimposed relationship to the predetermined envelope assembly, and for moving the two assemblies synchronously in the same direction so that said predetermined insert assembly is superimposed over said predetermined envelope assembly, said means for moving the predetermined envelope assembly includes means for causing the predetermined insert assembly to be deposited on said moving predetermined envelope assembly, means for folding the predetermined envelope assembly around the predetermined insert assembly, said predetermined envelope assembly being part of a continuous web of envelope assemblies connected together in lengthwise relationship to each other, cutter means being provided to separate the envelope assemblies from each other, said predetermined insert assembly being part of a continuous web of insert assemblies connected together in lengthwise relationship to each other, cutter means being provided to separate the insert assemblies from each other, the path of said predetermined insert assembly and said predetermined envelope assembly being in substantially superimposed relationship to each other, said envelope assembly moving means comprises conveyor means, said insert assembly moving means comprises a slide chute overlying the conveyor means down which the insert assembly slides, said slilde chute having a lower toe overlying the conveyor means, said lower toe pointing in the direction of travel of the said paths and the said conveyor, said envelope assembly moving means comprising conveyor means having upstanding pins adapted to strike the envelope assembly, slits being provided in said chute to permit the pins to strike the insert assembly and push it off the toe and onto an envelope assembly, a folding mechanism is provided adjacent the upper edge of said slide chute to fold the insert assembly, means are provided for applying adhesive to the edges of the envelope assembly, said envelope assembly folding means comprises a ramp having a stop at its forward end and being spaced above the plane of the conveyor to form a gap and means for causing the envelope to fold along a fold line and to push the folding envelope through said gap, a deflecting mechanism is provided movable upwardly to close the gap and permit the envelope to move up the ramp and to thereafter be movable downwardly to open the gap to permit the envelope to pass through the gap, pressure applying means are provided to seal the edges of the folded envelope assembly, means are provided for transferring said folded envelope assembly to a flap folding means, said flap folding means comprises second conveyor means moving at an angle to said first conveyor means, pressure rollers are adapted to place the envelopes into contact with the second conveyor means, said pressure means comprises a roller assembly pivotally mounted above said second conveyor means, means to pivot said rollers from a raised position to allow an envelope assembly to be deposited on the second conveyor means to a lowered position in contact with the envelope assembly, means to apply adhesive to the flap and means are provided to turn the flap, and a pressure roller is provided to seal the flap.

2. A mechanism as claimed in claim 1 wherein each of said webs has perforations along the edges and wherein means are provided for removing the perforations.

3. A mechanism as claimed in claim 2 wherein a pair of insert assemblies and a pair of envelope assemblies are provided transversely of each other and their respective webs on either side of a center line of the webs.

4. A mechanism as claimed in claim 3 wherein a cutter is provided near the top of said chute to cut the insert assembly along the center to form a pair of inserts.

5. A mechanism as claimed in claim 4 wherein guides are provided on the chute to prevent the insert assembly from angling.

6. A mechanism as claimed in claim 5 wherein said adhesive applier applies adhesive to the edges of the envelope assembly and along the center line.

7. A mechanism as claimed in claim 6 wherein guide rails are provided on each side of the insert assembly when positioned on the envelope assembly to prevent adhesive from being applied to the inserts.

8. A mechanism as claimed in claim 7 wherein a cutter is provided after the folding mechanism to cut the envelope assembly along the center line to form a pair of envelopes.

9. A mechanism as claimed in claim 8 wherein means are provided to deposit additional inserts on said envelope assembly, in advance of the envelope folding mechanism, said means comprising a mechanism to position additional inserts over the first conveyor means to permit the pins to strike the inserts and cause them to drop on the envelope assembly.

* * * * *